US006247502B1

(12) United States Patent
Ekelund

(10) Patent No.: US 6,247,502 B1
(45) Date of Patent: Jun. 19, 2001

(54) METHOD OF WEAVING A MULTI-COLORED WEB, WEB PRODUCED ACCORDING TO THIS METHOD AND WARP ASSEMBLY THEREOF

(75) Inventor: Christer Ekelund, Horred (SE)

(73) Assignee: Linnevaveriet I Horred AB, Horred (SE)

( * ) Notice: Subject to any disclaimer, the term of this patent is extended or adjusted under 35 U.S.C. 154(b) by 0 days.

(21) Appl. No.: 09/341,053

(22) PCT Filed: Jan. 2, 1998

(86) PCT No.: PCT/SE98/00002

§ 371 Date: Jul. 1, 1999

§ 102(e) Date: Jul. 1, 1999

(87) PCT Pub. No.: WO98/29588

PCT Pub. Date: Jul. 9, 1998

(30) Foreign Application Priority Data

Jan. 2, 1997 (SE) ..... 9700003

(51) Int. Cl.[7] ..... D03D 23/00; D03C 13/00

(52) U.S. Cl. ..... 139/1 R; 139/383 R; 139/420 R; 139/35; 139/59

(58) Field of Search ..... 139/35, 59, 383 R, 139/420 R, 1 R; D03C 13/00, 3/00; D03D 23/00, 25/00

(56) References Cited

U.S. PATENT DOCUMENTS 1,096,702 5/1914 Fleischer .
3,434,510 * 3/1969 Neyret .
4,197,345 * 4/1980 Worrall ..... 428/258

FOREIGN PATENT DOCUMENTS 4438535 5/1996 (DE) .
0692562 1/1996 (EP) .

OTHER PUBLICATIONS

Oelsner, A Handbook of Weaves, The Macmillan Co., 1915, pp. 350–351.*

* cited by examiner

*Primary Examiner*—John J. Calvert
*Assistant Examiner*—Robert H. Muromoto, Jr.
(74) *Attorney, Agent, or Firm*—Davis & Bujold, P.L.L.C.

(57) ABSTRACT

The present invention relates to a method of weaving a multi-colored web (5,6,7) with various colored wrap threads (1,2,3,) and weft threads (4). According to the invention wrap threads having preferably three different colors, namely blue, red, and yellow, are used, in regular series adjacent to each other. One of these colors is emphasized locally by the corresponding admixture into the front side of the web, which is being woven, in order to strengthen the shade. By the corresponding admixture of two or more colors new shades are obtained. The invention also relates to a multi-colored web (5,6,7), produced according to this method as well as to a wrap thread arrangement (1,2,3), used in or for the method and web respectively.

21 Claims, 1 Drawing Sheet

1
2
3
4
5
6
7

METHOD OF WEAVING A MULTI-COLORED WEB, WEB PRODUCED ACCORDING TO THIS METHOD AND WARP ASSEMBLY THEREOF

FIELD OF THE INVENTION

The present invention relates to a method of weaving a multi-colored web. Also, the invention relates to a multi-colored web, woven by means of the method, which relates to this web. Also, the invention relates to a warp thread assembly, designed for said method and said multi-colored web respectively, according to the first claim, which relates to such an assembly.

BACKGROUND OF THE INVENTION

A web or weaved fabric comprises, as is well known, longitudinal warp threads and transversal weft threads. The warp threads preferably are continuous in order to be able to carry out the weaving in a continuous fashion on a jaquard-loom.

In order to obtain varying colors and patterns respectively in a fabric so far a certain combination of warp and/or weft threads, colored in various ways, has been put together in a way, that is time-consuming, complicated and results in extra costs. During the entire warp length this putting together has then been restricted to said combination and the pattern obtained thereby. A normal warp length is 500-2000 m. The colors and the patterns respectively then were visible through the color positions in the warp and the weft respectively and through the bonding patterns. This has resulted in, that during the weaving it has not been possible to change a certain patterned product more than at the most to a very insignificant extent.

In order to, in a weaved web, obtain many colors in a refined way it is necessary to weave in several web layers by means of so called double weaving, which is a technique, which results in a thick weave, which it is only possible to produce in a slow way. Also, it is necessary to weave large amounts of each pattern and color position of the pattern. The double weaving is used e.g. when it is desirble to conceal a colored thread on the rear side of the web in order to make it invisible on the front side.

EP-A1-0 692 562 relates to a method of simulating the true appearance of a web on a computer display device without first having to weave it. Considering the dynamic condition and behaviour of the warp and weft threads the already measured behavior of these threads can be corrected. A web pattern can also, according to this document, be detected and fed into data equipment and be shown on a display device respectively. The various threads can of course have different chosen colors. However, the drawbacks and deficiences mentioned above exist also in a product according to this document.

DE-A1-4 438 535 also starts from a fictitious pattern, which is divided into screen dots from three basic colors as well as black and white, each screen dot having at least the size of a weavable point. The web is then woven according to the jaquard process, various colors being obtained by combining various adjacent weaveable joints from said colors. This document starts with the additive color mixing, which is used in e.g. the printing field. This document does not mention, which threads are considered, e.g. no distinction is made between warp and weft threads and also, there is no assumption of any regularity whatsoever. Consequently, the practical weaving according to the suggested method seems to relate to just one already determined product, in which purely summarily savings can be made by limiting the number of starting colors. When a new product is to be produced, it appears to be inevitable to start from the beginning with anew arrangement of all the conditions. This method apparently is useful only for double weaving, in which the threads are concealed on the rear side. Thus, this method is also impaired by the already described drawbacks and deficiences.

Finally, U.S. Pat. No. 1,096,702 relates to a method of applying various colored warp threads with a minimal waste on a warp beam. The color arrangement is determined by the individual pattern, which is to be weaved, and has to be changed, when another pattern is to be used. Thus, also in this case the already described drawbacks and deficiences remain.

SUMMARY OF THE INVENTION

One object of the present invention is to counteract and as far as possible eliminate the above-mentioned problems and drawbacks. More particularity, it must be possible to retain the warp thread arrangement during the entire warp length and thereby achieve maximal variation possibilities as to colors, patterns and shapes in the web arrangement. Also, it must be possible to produce a short series of a certain product and a certain pattern respectively without having to change or modify the warp arrangement. In addition to these objects it must be possible to adjust, in an easier, quicker, simpler and more economic way, a new weaving technique to computer control techniques and in this way using these techniques to obtain almost arbitrary, preprogrammed variations as to colors, patterns and shapes respectively using the same warp thread arrangement.

These objects are attained by using a method of the type described in the introduction, in the way that is set forth in below invention. Said objects are also attained by using a multi-colored web, which defines such a web. Finally, said objects are also attained by using a warp thread arrangement which defines such an arrangement.

BRIEF DESCRIPTION OF DRAWINGS

Additional characterizing features and advantages of the invention are mentioned in the following description, reference being made to the enclosed drawings, which depict a few preferred, but not limiting, embodiments of the invention. The drawings show in detail.

DESCRIPTION OF THE PREFERRED EMBODIMENTS

Figures 1, 2, 3, 4, 5, 6:
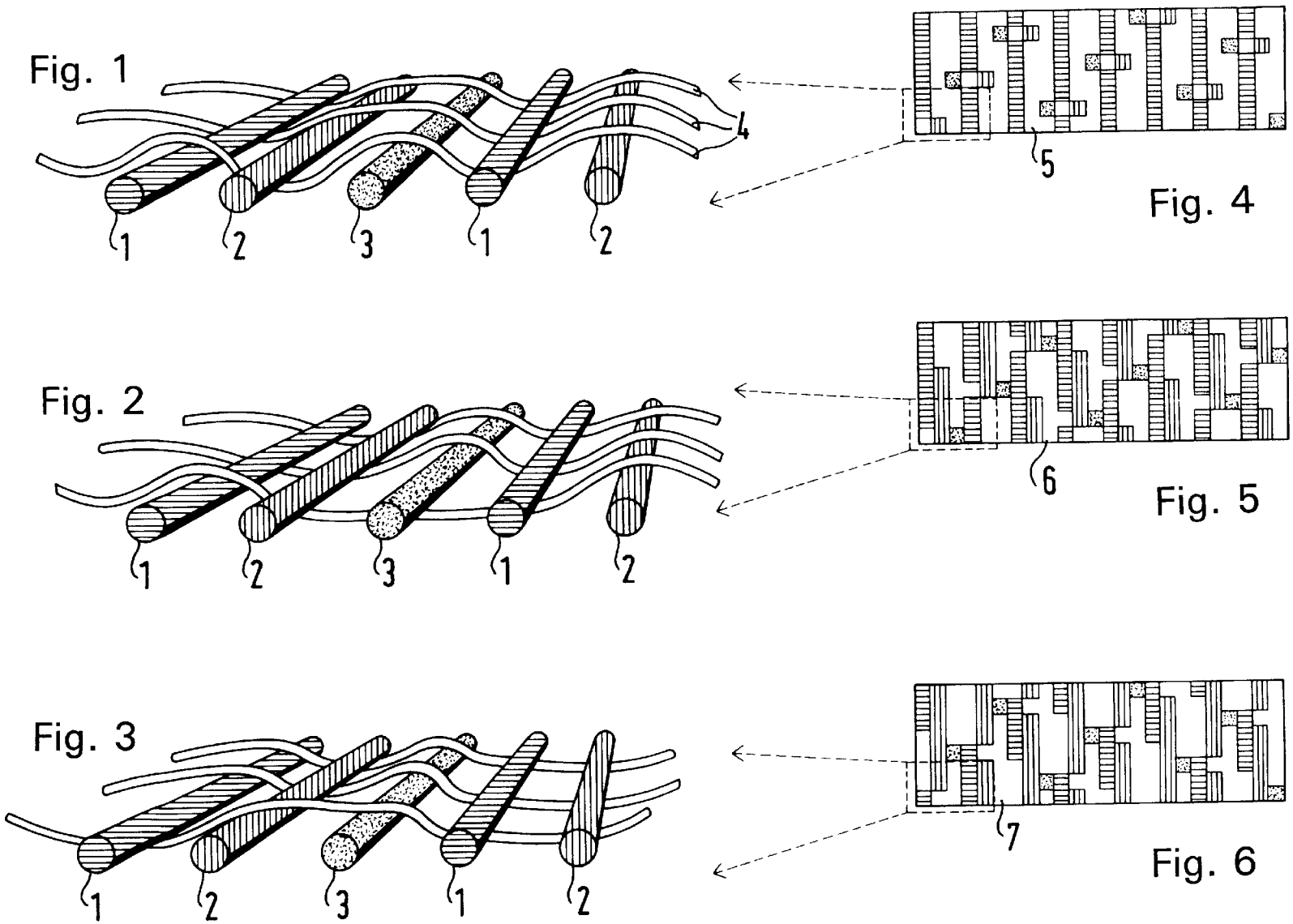
FIG. 1 is a section of first web according to the invention in a view from above and with an enlarged part in a perspective view
FIG. 2 is a corresponding section of a second web according to the invention in a view from above and with an enlarged part in a perspective view, using the same or identical warp thread arrangement as the one shown in FIG. 1.
FIG. 3 is a corresponding section of a third web according to the invention in a view from above and with an enlarged part in a perspective view, using the same or identical warp thread arrangement as the one shown in FIG. 1.
FIG. 4 is a top plan view of the web manufactured in accordance with the weaving arrangement of FIG. 1.
FIG. 5 is a top plan view of the web manufactured in accordance with the weaving arrangement of FIG. 2.
FIG. 6 is a top plan view of the web manufactured in accordance with the weaving arrangement of FIG. 3.

The basic idea of the present invention is to design the warp in such a way, that different colors and color combinations can be emphasized in effect anywhere in a web or fabric, which is to be woven. This is rendered possible by using warp threads with different colors, the colors of which are repeated at least substantially with regularity. A blue warp thread 1, a red warp thread, 2 and a yellow warp thread 3, placed adjacent to each other and followed in series by the same colors, preferably are to be used. Of course, the sequence can vary. Also, two or indeed three warp threads having the same color can be placed adjacent to each other, which then are followed by two or three warp threads having the second and finally two or three warp threads having the third color. It is also possible to mix one or several, preferably evenly distributed warp threads into a fourth color, e.g. a monochrome color between white and black and/or green. The weft or weft threads 4 can have an arbitrary color, e.g. a monochrome color between white and black.

Since these relatively few but among themselves strongly varying colors are available close to each other and consequently in effect everywhere in the longitudinal as well as the transversal direction of the fabric, which is being woven, it is possible in the bindings to emphasize or suppress a certain color or two certain colors and also by combining two or possibly three colors to obtain new color effects. Illustrations of these possibilities are shown in the drawings, in which blue warp treads 1 are followed by red warp threads 2 and yellow warp threads 3. This color sequence is then repeated along the transversal direction of the entire warp.

In fabric 5, obtained according to FIG. 1, blue warp threads 1 are emphasized up to 77.8% in 56 overlappings, red warp threads 2 up to 11.1% in 8 overlappings and yellow warp threads 3 up to 11.1% in 8 overlappings. Thus, the blue color is emphasized maximally within the shown section and the two other colors minimally.

In fabric 6, obtained according to FIG. 2, blue warp threads 1 are emphasized up to 53.8% in 56 overlappings, red warp threads 2 up to 38.5% in 40 overlappings and yellow warp threads 3 up to 7.7% in 8 overlappings. Thus, the blue color is emphasized maximally within the shown section, the red color in a somewhat more than medium strong way and the yellow color minimally.

In fabric 7, obtained according to FIG. 3, blue warp threads 1 are emphasized up to 33.3% in 32 overlappings, red warp threads 2 up to 58.4% in 56 overlappings yellow warp threads 3 up to 8.3% in 8overlappings. The blue color is in this case emphasized in a medium strong way, the red color maximally and the yellow color minimally.

In all these cases weft 4 has one color, e.g. is white or is light-colored, which results in clear and bright colors in the woven fabric. If darker shades are desired, a darker weft is chosen and possibly a dark warp thread between or in the described and shown warp thread series. In contrast to the warp it is easy to change the weft and in a preprogrammable way. Thus, the warp color, which is to be emphasized, can be made stronger or modified by means of a desirable weft color. All shades can be made stronger by means of two or three weft colors. Since a normal loom construction can hold 8–16 or actually more weft colors, it is easy to put together a very large number of color combinations jointly with the warp color and warp colors respectively.

By binding the weft to substantially the same color as the respective warp thread, the color will be stronger. The few bindings, which possibly have to be carried out, to other warp thread colors, are carried out with the color, which to the least degree will influence the desired shade. For example, in order to emphasize a red color a yellow color is chosen rather than a blue color, which would have a greater influence.

If a maximal white ground color is desired, it is advantageous to have one or two neutral, e.g. white, threads in the warp.

More extreme colors, which hardly can be mixed, e.g. turquoise against green and fluorescent colors, suitably are to be added through the weft.

The binding of the treads to obtain various shades can be done by means of a plurality of more or less known binding techniques. It is important to make the interweaving regular in order to obtain a woven material having a smooth surface.

By using these binding techniques a woven material can be given desired colors, color combinations and color shades but also other desired characteristics, such as structure, softness, wear resistance etc.

The invention is not limited to the embodiments described above and shown in the drawings, which are to be regarded solely as exemplifications, which can be modified and supplemented in an arbitrary manner within the scope of the inventive idea and the following patent claims.

What is claimed is:

1. A method of weaving a single layer multi-colored web (5, 6, 7), having a front side and a rear side, from a plurality of colored warp threads (1, 2, 3) and a single color weft thread for one of emphasizing and suppressing desired colors of the plurality of colored warp threads (1, 2, 3) to achieve a desired pattern for the single layer multi-colored web (5, 6, 7), the method comprising the steps of:

selecting the single colored weft thread (4);

selecting at least three different color warp threads (1, 2, 3);

arranging said at least three different color warp threads (1, 2, 3) adjacent to one another in a desired first sequence of the at least three different color warp threads (1, 2, 3);

repeating the desired first sequence of the at least three different color warp threads to obtain adiacent identical sequences of the at least three different color warp threads and the single colored weft thread with the adiacent identical sequences forming a series of repeating identical sequences and each of the at least three different color warp threads in the series being of a single contiguous elongate length of thread;

weaving said multi-colored web so that one of said at least three different color warp threads (1, 2, 3) is emphasized to achieve a quantitative admixture on the front side of the multi-colored web (5, 6, 7); and mixing at least two of the at least three different color warp threads (1, 2, 3) in order to obtain at least one new shade of color on the front side of the multi-colored web (5, 6, 7).

2. The method according to claim 1 further comprising the step of using at least one blue warp thread (1), at least one red warp thread (2) and at least one yellow warp thread (3) as the at least three different color warp threads (1, 2, 3).

3. The method according to claim 2 further comprising the step of using at least one additional warp thread, having a monochrome color between white and black, in the desired repeating sequence of the different color warp threads (1, 2, 3).

4. The method according to claim 2 further comprising the steps of using at least one additional warp thread, having a monochrome color between white and black, in the desired repeating sequence of the different color warp threads (1, 2, 3); and using one of a white thread and a light color thread as the single colored weft thread (4).

5. The method according to claim 2 further comprising the steps of using two additional warp threads, each having a monochrome color between white and black, in the desired repeating sequence of the different color warp threads (1, 2, 3); and using one of a white thread and a light color thread as the single colored weft thread (4).

6. The method according to claim 2 further comprising the steps of using a green thread as an additional warp thread in the desired repeating sequence of the different color warp threads (1, 2, 3); and using one of a white thread and a light color thread as the single colored weft thread (4).

7. The method according to claim 1 further comprising the step of using a monochrome color, between white and black, as the single colored weft thread (4).

8. The method according to claim 1 further comprising the steps of forming the desired repeating sequence of the at least three different color warp threads (1, 2, 3) to comprise two identically first colored warp threads (1, 2 or 3) located adjacent one another, which is followed by two identically second colored warp threads (1, 2 or 3) located adjacent one another and this is followed by two identically third colored warp threads (1, 2 or 3) located adjacent one another.

9. The method according to claim 1 further comprising the steps of forming the desired repeating sequence of the at least three different color warp threads (1, 2, 3) to comprise three identically first colored warp threads (1, 2 or 3) located adjacent one another, which is followed by three identically second colored warp threads (1, 2 or 3) located adjacent one another and this is followed by three identically third colored warp threads (1, 2 or 3) located adjacent one another.

10. The method according to claim 1 further comprising the steps of maximally emphasizing a first one of the at least three different colored warp threads (1, 2, 3) while minimally an effect of the remaining two of the at least three different colored warp threads (1, 2, 3).

11. The method according to claim 10 further comprising the step of maximally emphasizing the first one of the at least three different colored warp threads (1, 2, 3) by at least 53.8% over the effect of the remaining two of the at least three different colored warp threads (1, 2, 3).

12. The method according to claim 1 further comprising the steps of maximally emphasizing a first one of the at least three different colored warp threads (1, 2, 3) and minimally emphasizing a third one of the at least different colored warp threads (1, 2, 3) and emphasizing a second one of the at least three colored warp threads (1, 2, 3) which is less than the maximally emphasized first colored warp thread (1, 2, 3) and greater than the minimally emphasized third colored warp threads (1, 2, 3).

13. The method according to claim 12 further comprising the steps of maximally emphasizing the first one of the at least three different colored warp threads (1, 2, 3) by about 58.4% over the effect of the remaining two of the at least three different colored warp threads (1, 2, 3), minimally emphasizing the third one of the at least different colored warp threads (1, 2, 3) by about 8.3% over the effect of the remaining two of the at least three different colored warp threads (1, 2, 3) and emphasizing the second one of the at least three colored warp threads (1, 2, 3) by about 33.3% over the effect of the remaining two of the at least three different colored warp threads (1, 2, 3).

14. The method according to claim 12 further comprising the steps of maximally emphasizing the first one of the at least three different colored warp threads (1, 2, 3) by about 53.8% over the effect of the remaining two of the at least three different colored warp threads (1, 2, 3), minimally emphasizing the third one of the at least different colored warp threads (1, 2, 3) by about 7.7% over the effect of the remaining two of the at least three different colored warp threads (1, 2, 3) and emphasizing the second one of the at least three colored warp threads (1, 2, 3) by about 38.5% over the effect of the remaining two of the at least three different colored warp threads (1, 2, 3).

15. A method of weaving a single layer multi-colored web (5, 6, 7), having a front side and a rear side, from a plurality of colored warp threads (1, 2, 3), and a single color weft thread for one of emphasizing and suppressing desired colors of the plurality of colored warp threads (1, 2, 3) to achieve a desired pattern for the single layer multi-colored web (5, 6, 7), the method comprising the steps of:

selecting the single colored weft thread (4);

selecting at least three different color warp threads (1, 2, 3);

arranging said at least three different color warp threads (1, 2, 3) adjacent to one another in a desired first sequence of the at least three different color warp threads (1, 2, 3);

repeating the desired first sequence of the at least three different color warp threads to obtain adiacent identical sequences of the at least three different color warp threads and the single colored weft thread with the adjacent identical sequences forming a series of repeating identical sequences and each of the at least three different color warp threads in the series being of a single contiguous elongate length of thread;

weaving said multi-colored web whereby one of said at least three different color warp threads (1, 2, 3) is emphasized to achieve a quantitative admixture on the front side of the multi-colored web (5, 6, 7); and mixing at least two of the at least three different color warp threads (1, 2, 3) in order to obtain at least one new shade of color on the front side of the multi-colored web (5, 6, 7); and maximally emphasizing a first one of the at least three different colored warp threads (1, 2, 3).

16. The method according to claim 15 further comprising the steps of using at least one blue warp thread (1), at least one red warp thread (2) and at least one yellow warp thread (3) as the at least three different color warp threads (1, 2, 3);

using at least one additional warp thread, having a monochrome color between white and black, in the desired repeating sequence of the different color warp threads (1, 2, 3).

17. The method according to claim 15 further comprising the steps of using at least one blue warp thread (1), at least one red warp thread (2) and at least one yellow warp thread (3) as the at least three different color warp threads (1, 2, 3);

using at least one additional warp thread, having a monochrome color between white and black, in the desired repeating sequence of the different color warp threads (1, 2, 3); and using one of a white thread and a light color thread as the single colored weft thread (4).

18. The method according to claim 15 further comprising the steps of forming the desired repeating sequence of the at least three different color warp threads (1, 2, 3) to comprise three identically first colored warp threads (1, 2 or 3) located adjacent one another, which is followed by three identically second colored warp threads (1, 2 or 3) located adjacent one another and this is followed by three identically third colored warp threads (1, 2 or 3) located adjacent one another.

19. The method according to claim 15 further comprising the step maximally emphasizing the first one of the at least three different colored warp threads (1, 2, 3) by at least 53.8% over the effect of the remaining two of the at least three different colored warp threads (1, 2, 3).

20. A multi-colored web (5, 6, 7), having a front side and a rear side, the multi-colored web (5, 6, 7) being woven from a plurality of colored warp threads (1, 2, 3), and a single color weft thread for one of emphasizing and suppressing desired colors of the plurality of colored warp threads (1, 2, 3) to achieve a desired pattern for the multi-colored web (5, 6, 7), wherein the multi-colored web (5, 6, 7) is woven by the method of:

selecting the single colored weft thread (4);

selecting at least three different color warp threads (1, 2, 3);

arranging said at least three different color warp threads (1, 2, 3) adjacent to one another in a desired first sequence of the at least three different color warp threads (1, 2, 3);

repeating the desired first sequence of the at least three different color warp threads to obtain adiacent identical sequences of the at least three different color warp threads and the single colored weft thread with the adiacent identical sequences forming a series of repeating identical sequences and each of the at least three different color warp threads in the series being of a single contiguous elongate length of thread;

weaving said multi-colored web whereby one of said at least three different color warp threads (1, 2, 3) is emphasized to achieve a quantitative admixture on the front side of the multi-colored web (5, 6, 7); and mixing at least two of the at least three different color warp threads (1, 2, 3) in order to obtain at least one new shade of color on the front side of the multi-colored web (5, 6, 7).

21. A method of weaving a multi-colored web (5, 6, 7), having a front side and a rear side, from a weft thread (4) and a plurality of colored warp threads (1, 2, 3) for one of emphasizing and suppressing desired colors of the plurality of colored warp threads (1, 2, 3) to achieve a desired color mixing effect for the multi-colored web (5, 6, 7), the method comprising the steps of:

using a single colored weft thread (4);

selecting at least three different color warp threads (1, 2, 3);

arranging said at least three different color warp threads (1, 2, 3) adjacent to one another in a desired repeating sequence of the at least three different color warp threads (1, 2, 3);

weaving one of said at least three different color warp threads (1, 2, 3) to achieve a quantitative admixture on the front side of the multi-colored web (5, 6, 7);

mixing at least two of the at least three different color warp threads (1, 2, 3) in order to obtain at least one new shade of color on the front side of the multi-colored web (5, 6, 7); and maximally emphasizing a first one of the at least three different colored warp threads (1, 2, 3) by at least 53.8% over an effect of the remaining two of the at least three different colored warp threads (1, 2, 3).

* * * * *